US007735262B2

(12) United States Patent
Peterson

(10) Patent No.: US 7,735,262 B2
(45) Date of Patent: Jun. 15, 2010

(54) POCKET DOOR MOUNTING SYSTEM

(76) Inventor: Jim Peterson, 5245 Louisiana Pl., Santa Barbara, CA (US) 93111

( * ) Notice: Subject to any disclaimer, the term of this patent is extended or adjusted under 35 U.S.C. 154(b) by 382 days.

(21) Appl. No.: 10/893,186

(22) Filed: Jul. 16, 2004

(65) Prior Publication Data

US 2006/0010774 A1 Jan. 19, 2006

(51) Int. Cl.
*E05D 15/06* (2006.01)

(52) U.S. Cl. ..... 49/372; 49/409; 49/452

(58) Field of Classification Search ..... 49/372, 49/409, 452, 231; 16/95 R, 96 R; 248/289.11, 248/291.1, 288.11
See application file for complete search history.

(56) References Cited

U.S. PATENT DOCUMENTS

| | | | | | |
|---|---|---|---|---|---|
| 447,505 | A | * | 3/1891 | Coburn | 16/102 |
| 540,444 | A | | 6/1895 | Hoefer | |
| 568,171 | A | * | 9/1896 | Schlutter | 16/105 |
| 595,180 | A | * | 12/1897 | Kuster | 16/102 |
| 675,762 | A | * | 6/1901 | Walradt | 16/94 R |
| 708,205 | A | | 9/1902 | Clift | |
| 797,031 | A | * | 8/1905 | Vivian | 16/96 R |
| 851,780 | A | * | 4/1907 | Schuyler | 49/372 |
| 2,649,612 | A | * | 8/1953 | Loomis | 16/94 R |
| 3,152,354 | A | * | 10/1964 | Diack | 16/94 R |
| 3,480,989 | A | * | 12/1969 | Edeus | 16/94 R |
| 3,727,349 | A | * | 4/1973 | Bainbridge | 49/411 |
| 3,842,462 | A | * | 10/1974 | Bainbridge | 16/94 R |
| 4,561,210 | A | * | 12/1985 | Kvas et al. | 49/372 |
| 4,742,645 | A | | 5/1988 | Johnston | |
| 5,605,016 | A | | 2/1997 | Pollard | |
| 6,058,665 | A | | 5/2000 | Halvorson, Jr. et al. | |
| 6,289,643 | B1 | | 9/2001 | Bonar | |

* cited by examiner

*Primary Examiner*—Gregory J. Strimbu
(74) *Attorney, Agent, or Firm*—Christie, Parker & Hale, LLP

(57) ABSTRACT

A pocket door mounting system allows a pocket door to be easily leveled or adjusted after installation in a door opening. The system is installed in a level position in the area of a structural header. At each end of the system is a standard bracket or brackets which attach to vertical framing members on either side of the door opening. At one end of the system is an adjustment assembly having a vertically oriented adjustment screw. Raising or lowering the adjustment screw adjusts the pitch of the system relative to the door opening.

12 Claims, 11 Drawing Sheets

POCKET DOOR MOUNTING SYSTEM

FIELD OF THE INVENTION

The present invention relates generally to an improved pocket door mounting system. In particular, the invention relates to a system having an adjustment assembly allowing the system to be easily squared with a door frame after installation.

BACKGROUND OF THE INVENTION

A pocket door is a type of door most commonly used in residential construction which opens by sliding along a track into a pocket enclosed within a wall. The door may likewise be closed by sliding it out of the wall pocket and across a doorway opening. When in the open position, the pocket door is hidden within the wall pocket and as such makes a more efficient use of available space than conventional hinged doors which swing into and take up space within rooms they are opened into.

A door opening for receiving a pocket door is ordinarily bounded by a frame header above and on either side by what are known as trimmers to those skilled in the art. Pocket door mounting systems commonly embody a track fastened directly to the frame header of the door opening. This track extends along the top of the door opening and into the wall pocket. One or more roller assemblies, from which hang the pocket door, ride along this track. In operation, the door suspended from the roller assembly is free to move in and out of the pocket in order to close and open the door.

When the door is fully open and residing within the wall pocket, the edge of the door should be flush with a jamb on the side of the door opening nearest to the wall pocket. The door should be flush with the jamb for the door's full height, top to bottom. Likewise, when the door is suspended from the track in the closed position, the edge of the door should fit neatly against the opposite trimmer or door jamb, top to bottom. Thus, necessary for a neat installation of the pocket door are these two conditions of having the edge of the door flush with the door trim when the door is open and having the edge of the door neatly fit against the jamb when the door is closed. In addition, if the pocket door is out of square with the door opening, it may have the additional problem of not being able to smoothly move along the track, or it might fail to clear the floor as it opens or closes.

As frequently occurs with the installation of job-hung pocket doors, it may not be possible to ensure the pocket door will remain completely square in the door opening as time passes. A particular difficulty arises with mechanical changes in the timber of the frame itself. The frame header in particular has been known to shrink as it dries bringing the pocket door out of square with the door opening.

Pocket doors are difficult to install in a manner which does not lead to the problems discussed above. The difficulty is compounded by the fact that a framing crew usually installs the pocket door mounting system and a separate finish crew installs the door itself. Heretofore, to correct a misalignment of the pocket door it has been necessary in practice to remove and reinstall the door jamb and trim in a complex and difficult operation.

SUMMARY OF THE INVENTION

A pocket door mounting system is provided to allow a pocket door to be easily leveled or adjusted after installation in a door opening. In brief, the present system is installed in a horizontal position in the area of a structural header. At each end of the system is a standard bracket or brackets which attach to vertical framing members (e.g. trimmers) on either side of the door opening. At one end of the system is an adjustment assembly having a vertically oriented adjustment screw. Raising or lowering the adjustment screw adjusts the pitch of the system relative to the door opening.

The pocket door mounting system comprises a track for mounting a sliding pocket door, an adjustment assembly connected to a first end of the track and a pivot assembly connected to a second end of the track. The adjustment assembly is capable of adjusting the pitch of the track relative to an axis running between the pivot assembly and the adjustment assembly by adjusting the position of the first end of the track.

In one embodiment of the present pocket door mounting system, the position of the first end of the track may be adjusted up to approximately one half inch by the adjustment assembly. In another embodiment, the track is able to mount a sliding pocket door in both an open and a closed position.

In another embodiment the adjustment assembly comprises at least one adjustment bracket attached to an adjustment block. The adjustment block is provided with a threaded hole for receiving an adjustment screw so that the adjustment screw can support the weight of the first end of the track.

The track may form a substantially constant radius of curvature along its length when subjected to a three point loading, or it may be formed from a relatively rigid member.

In yet another embodiment of the pocket door mounting system, the adjustment assembly comprises a pair of adjustment brackets forming a gap therebetween when connected to the adjustment block. The first end of the track is constrained to move only in a vertical direction in the gap formed between the pair of adjustment brackets.

Lastly, the pivot assembly may comprise at least one pivot bracket rotatably connected to the second end of the track at a pivot axis. The track may comprise both a track and a structural member, the track being attached to the structural member using self-tapping screws.

Figure 1:
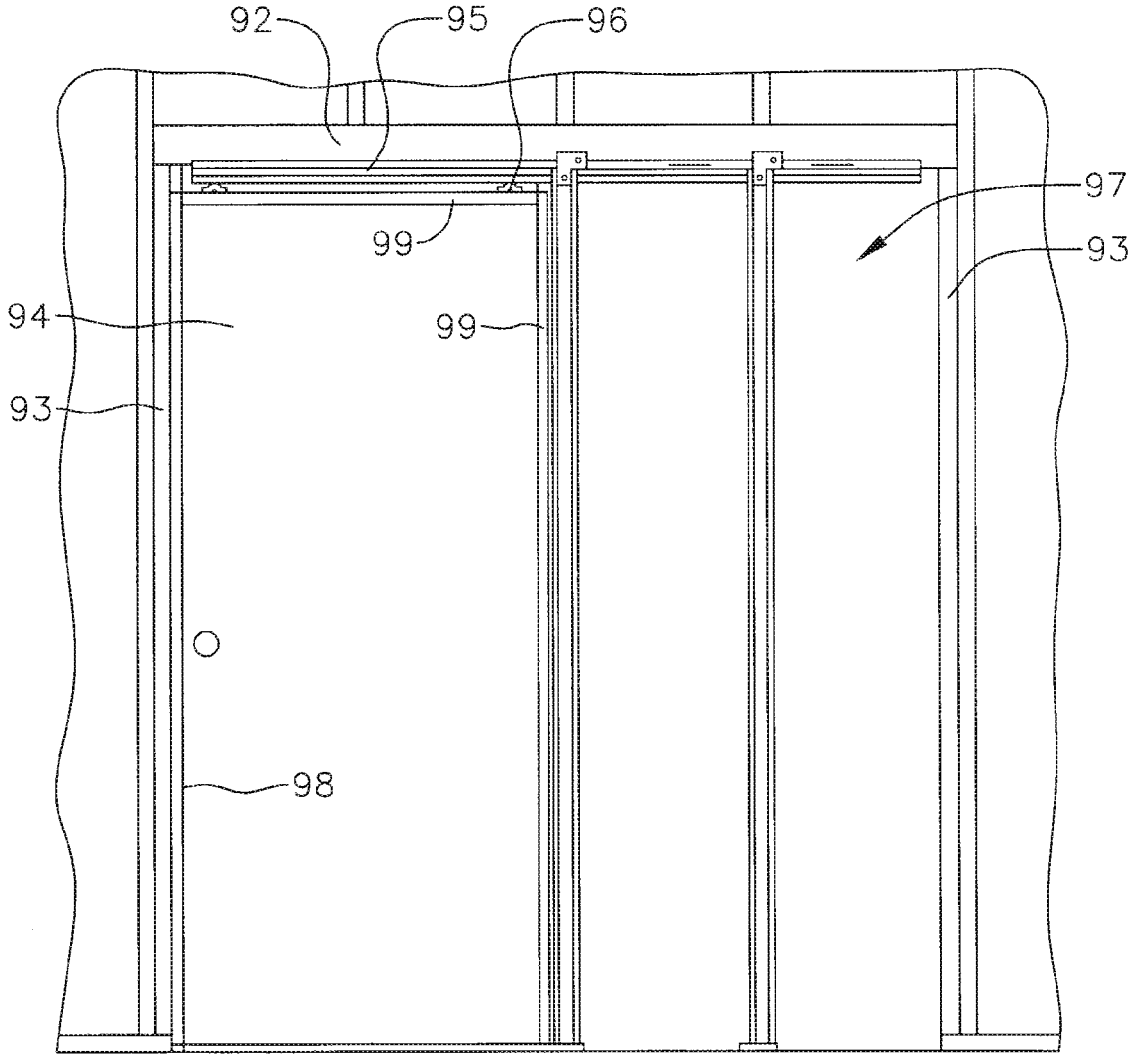
FIG. 1 PRIOR ART
FIG. 1 is a view of a door opening illustrating a prior art pocket door mounting system with the wall surface covering removed.

Before any embodiment of the invention is explained in detail it is to be understood that the invention is not limited in its application to the exemplary details of construction and arrangements of components set forth in the following description or illustrated in the drawings. The invention is capable of alternative embodiments and of being practiced or being carried out in various ways. Also, it is to be understood that the terminology used herein is for the purpose of illustrative description and should not be regarded as limiting.

DETAILED DESCRIPTION OF THE INVENTION

Referring now to the drawings, and more particularly to the prior art FIG. 1, a pocket door 94 is shown installed in a door opening having a horizontal frame header 92 and a pair of vertical trimmers 93 on either side of the opening. A prior art pocket door mounting system 95 is shown attached directly to the frame header 92 at the top of the door enclosure. A pair of rollers 96 allow the pocket door 94 to be hung from the pocket door mounting system 95. When a user desires to open the pocket door 94, she slides it along the track of the pocket door mounting system 95 and into the wall pocket 97, vacating the door opening, which is circumscribed by a door jamb 98 and door trim 99.

Because the structural members shown in FIG. 1 can shrink and warp after framing, the orientation of the door opening may change as a result. This shrinkage can cause the pocket door mounting system 95 shown in FIG. 1 to tilt up or down, or otherwise warp, thus throwing the pocket door 94 mounted thereon out of proper alignment in the door opening.

The framing members shown in FIG. 1 including the trimmers 93 and the frame header 92 are customarily covered during the course of construction with drywall or other suitable sheeting material, possibly accompanied by lengths of trim or finishing molding, making it difficult to correct a misalignment in the pocket door mounting system 95. The portion of the pocket door mounting system 95 that attaches to the frame header 92 above the door opening will be partially obscured, and the portion above the wall pocket 97 will be completely obscured by the sheeting material and associated molding. As a result, a person wishing to realign the pocket door mounting system 95 to level it and/or square it with the door opening will need to engage in an extensive teardown or remodeling of the existing structure surrounding the door opening before repairs can be effected, and an equally extensive rebuild afterwards.

Figures 2, 3, 4, 5:
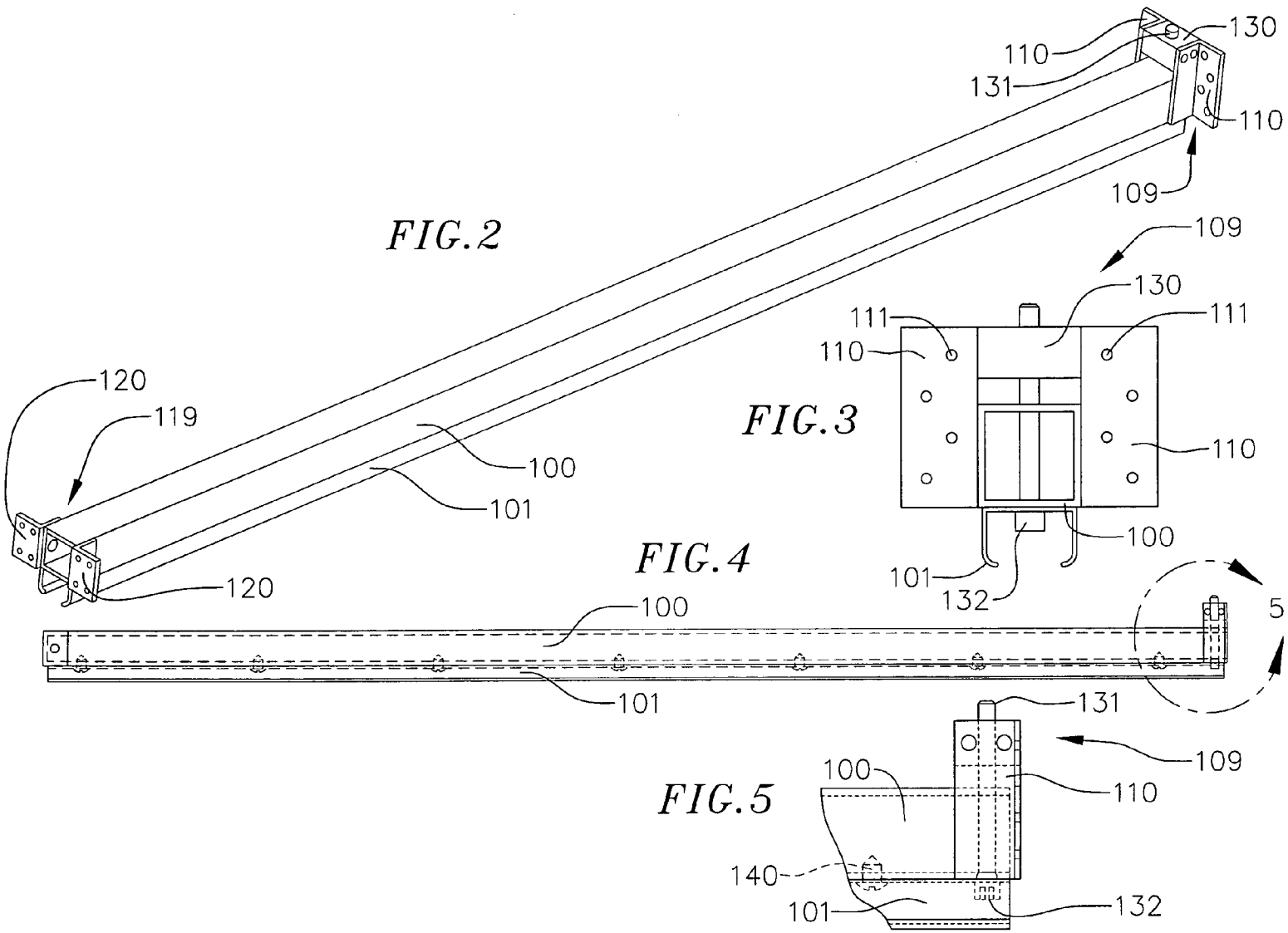
FIG. 2 is a perspective view of the pocket door mounting system of the present invention.
FIG. 3 is an end view of the pocket door mounting system of FIG. 2, showing the adjustment assembly in greater detail.
FIG. 4 is a side view of the pocket door mounting system of FIG. 2.
FIG. 5 is a side view of the adjustment assembly of FIG. 3.

FIG. 2 shows an illustration of an embodiment of a pocket door mounting system according to the present invention. The present system is designed so that rather than be connected to the frame header 92 shown in FIG. 1 running across the top of the door opening, as in prior art mounting systems, the present system may run between and be attached to the pair of vertical trimmers 93 or other members in the proximity of a door opening and framing the door opening on either side.

The system comprises a elongated bar 100 running between an adjustment assembly 109 and a pivot assembly 119. In an exemplary embodiment, the elongated bar 100 forms a substantially constant radius of curvature along its length when subjected to a three point loading. These two assemblies are provided with a pair of adjustment brackets 110 and a pair of pivot brackets 120, respectively, so that they may be attached to the trimmers framing the door opening with wood screws or other appropriate fasteners.

A track 101 is provided attached to the bottom of the elongated bar 100. A pocket door on a set of rollers may be mounted on the track 101 in such a fashion so that it may be moved along the track 101 into and out of the wall pocket to open and close the door.

In the event the structural header shrinks after installation of the pocket door on a job-hung basis, the present pocket door mounting system may, just as with the prior art system shown in FIG. 1, become tilted out of square with the door opening. To address this problem, the present pocket door mounting system is provided with the adjustment assembly 109, which includes an adjustment screw, the turning of which raises or lowers the end of the elongated bar mounting in the adjustment assembly. This process is described in more detail in the context of the additional figures that follow.

In an embodiment of the present pocket door mounting system, the pivot brackets 120 are mounted on a trimmer within the wall pocket holding the pocket door in its fully open position. The adjustment brackets 110 are provided mounted on the outside trimmer furthest from the wall pocket and beside the door opening.

In an alternative embodiment, the adjustment brackets 110 may be provided with horizontal flanges allowing the brackets to be attached to the overhead frame header, rather than the trimmer beside the door opening. Because the adjustment brackets 110 are part of the adjustment assembly 109, the assembly will still be able to correct a misalignment in the pocket door mounted system regardless of a movement of the structure to which the system is mounted.

In a further alternative embodiment, the pivot brackets 120 may be likewise modified to attach to the overhead frame header rather than to the trimmers lining the door opening. Although the pivot assembly 119 lacks the adjustability inherent to the adjustment assembly 109, and therefore can't reposition the end of the elongated bar 100 extending into the door pocket where the pivot assembly is located, it is less critical that it be able to do so given that a substantial portion of the misalignment in the elongated bar 100 caused by a movement of the pivot assembly 119 will be hidden within the door pocket.

FIG. 3 shows a close-up view of the adjustment assembly 109 of the present pocket door mounting system. The assembly incorporates a pair of adjustment brackets 110, which are provided with adjustment bracket mounting holes 111 allowing the adjustment brackets 110 to be screwed to a trimmer or other member surrounding the door opening. An adjustment block 130 is provided attached to the adjustment brackets 110. An adjustment screw 131 is provided threaded into the adjustment block 130 and running downwards through the elongated bar 100 to suspend the elongated bar 100 within the gap created between the adjustment brackets 110.

The adjustment screw 131 is vertically oriented and, in one embodiment of the present pocket door mounting system, is provided with approximately one half inch of travel into or out of the adjustment block 130. The adjustment screw 131 includes a screw head 132 having an appropriate adjustment device such as an allen or phillips socket, or a hexagonal shape to fit a wrench. The screw head 132 is larger in diameter than the shaft of the screw 131, and larger than the hole through which it passes in the elongated bar 100. The adjustment screw may thus be held in tension between the adjustment block 130 and the elongated bar 100, as well as the components of the present system that attach thereto. When the adjustment screw 131 is adjusted by a user of the pocket door mounting system it results in the raising or lowering the head of the adjustment screw 131. As a result, the end of the elongated bar 100 through which the adjustment screw 131 runs will also be raised or lowered.

FIG. 4 shows a side view of the pocket door mounting system shown in FIG. 2. FIG. 5 shows a more detailed side view of the adjustment assembly 109 shown in FIG. 3. FIG. 5 shows another view of the screw head 132 provided at the end of the adjustment screw 131 such the wide screw head 132 will support the elongated bar 100.

Figures 6, 7, 8:
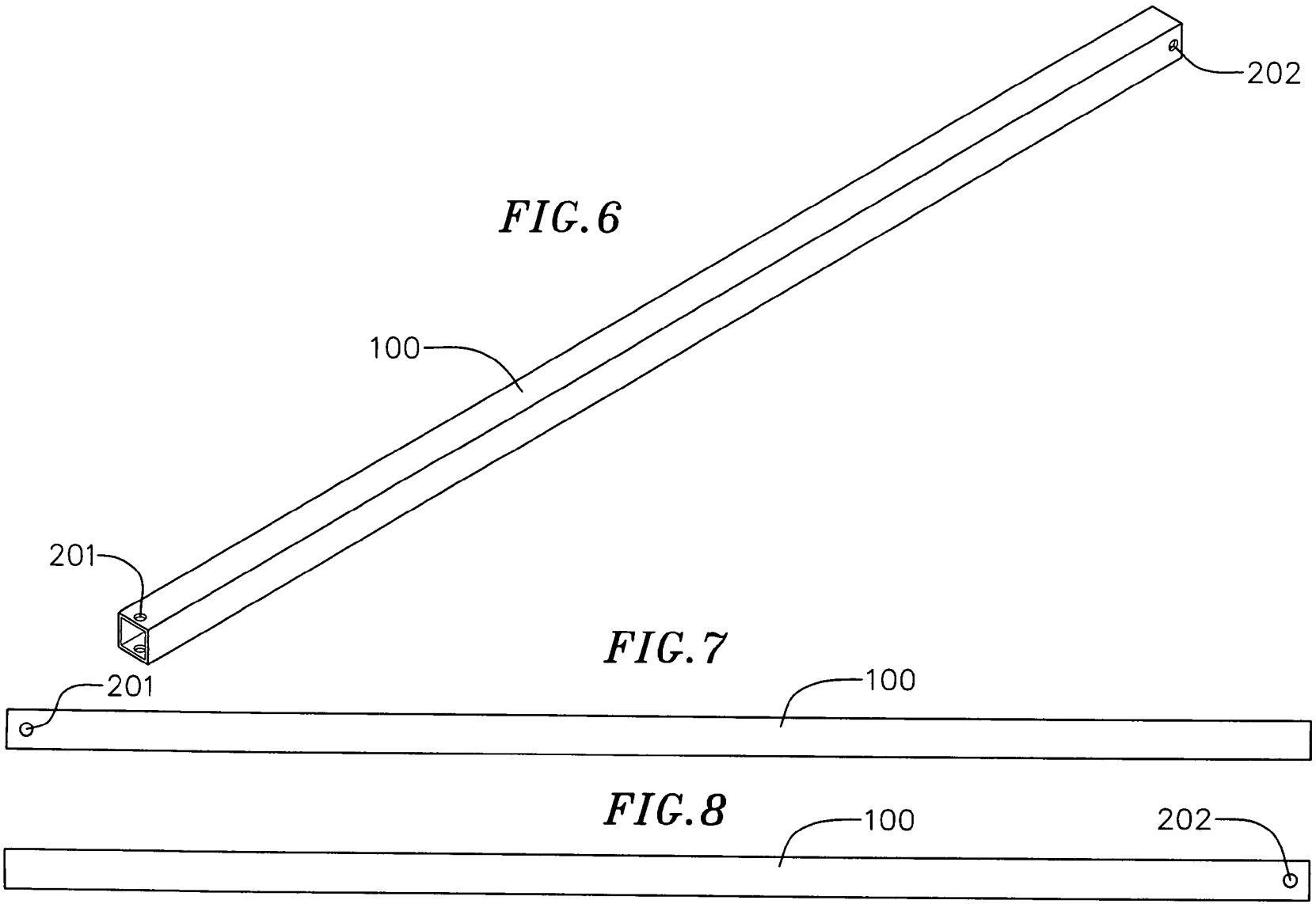
FIG. 6 is a perspective view of an elongated bar of the present pocket door mounting system.
FIG. 7 is a top view of the elongated bar of FIG. 6.
FIG. 8 is a side view of the elongated bar of FIG. 6.

FIG. 6 shows an isometric view of the elongated bar 100 used as a component of the present pocket door mounting system. The elongated bar 100 is shown having an adjustment hole 201, through which passes the adjustment screw 131 as shown in FIGS. 3, 4 and 5. The elongated bar 100 is also shown having a bar pivot hole 202. FIGS. 7 and 8 show a top and a side view, respectively, of the elongated bar of FIG. 6.

Figure 9:
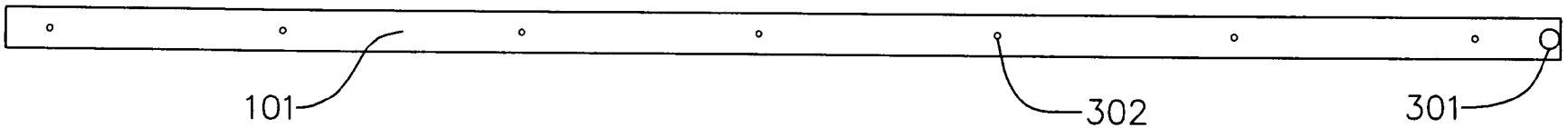
FIG. 9 is a top view of the track of the present pocket door mounting system.
Figure 10:
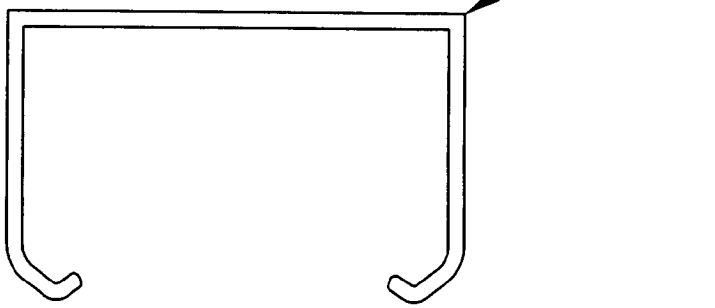
FIG. 10 is an end view of the track of FIG. 9.
Figure 11:
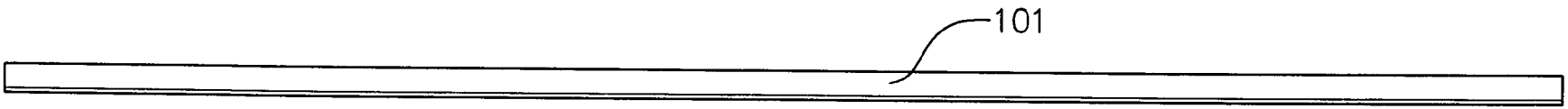
FIG. 11 is a side view of the track of FIG. 9.

FIG. 9 shows a top view of the track 101 of the present pocket door mounting system. The track 101 may be a commercially available track such as a Stanley track, for example. The track 101 is shown having track mounting holes 302 allowing the track 101 to be more easily attached to the elongated bar 100 in the orientation shown in FIGS. 2 and 4. In one embodiment, self tapping screws 140 are used to attach the track 101 to the elongated bar 100, said screws 140 passing through the track mounting holes 302 in the track 101 and cutting their own holes in the material of the elongated bar 100 (see FIG.5). The track 101 is also shown having a screw head in the field cutout 301 to allow clearance for the screw head 132 when the track is attached to the elongated bar 100. FIGS. 10 and 11 show an end and a side view, respectively, of the track of FIG. 9.

Figure 12:
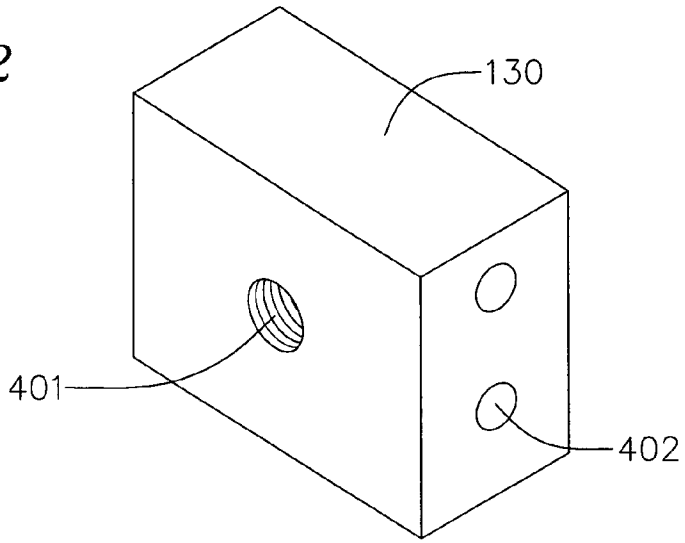
FIG. 12 is a perspective view of the adjustment block of the present invention.
Figure 14:
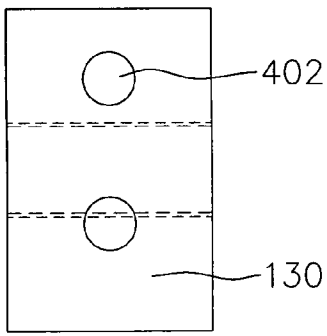
FIG. 14 is a side view of the adjustment block of FIG. 12.
Figure 13:
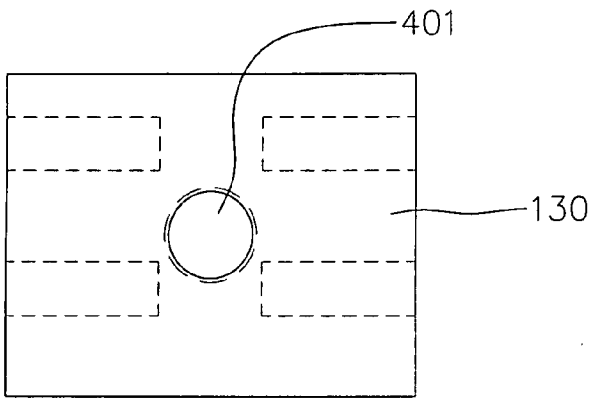
FIG. 13 is a front view of the adjustment block of FIG. 12.
Figure 15:
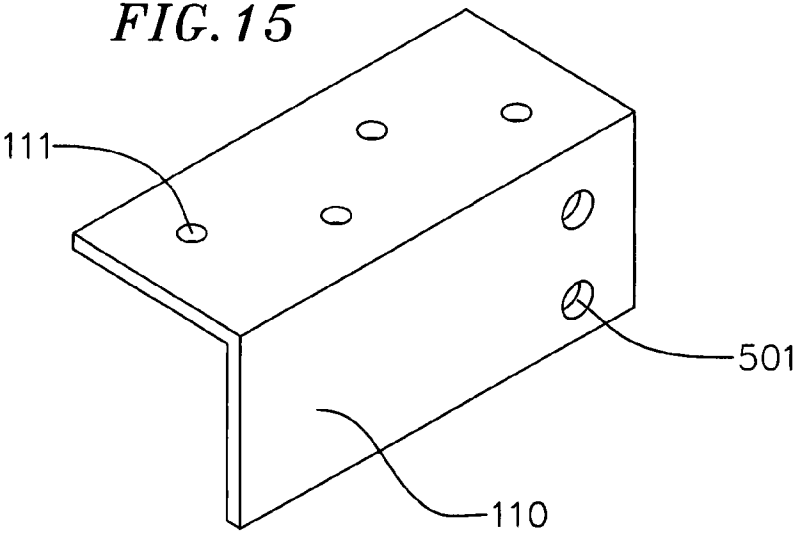
FIG. 15 is a perspective view of the adjustment bracket of the present pocket door mounting system.
Figure 16:
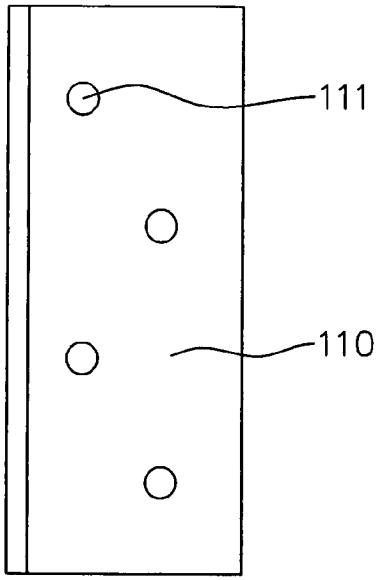
FIG. 16 is a top view of the adjustment bracket of FIG. 15.
Figure 18:
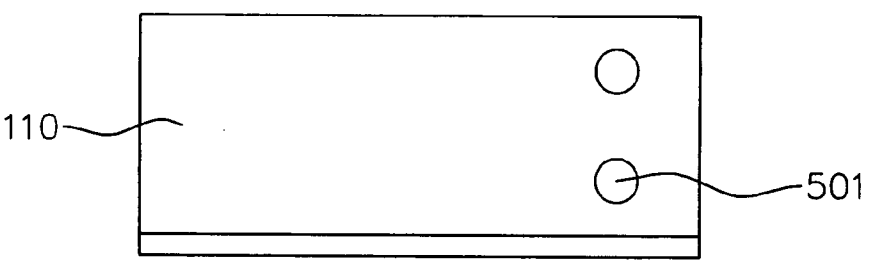
FIG. 18 is a side view of the adjustment bracket of FIG. 15.
Figure 17:
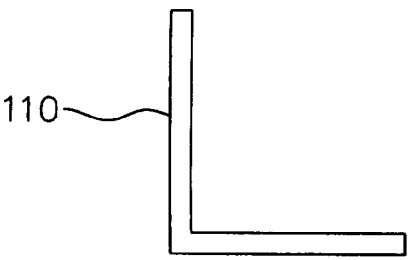
FIG. 17 is an end view of the adjustment bracket of FIG. 15.
Figure 19:
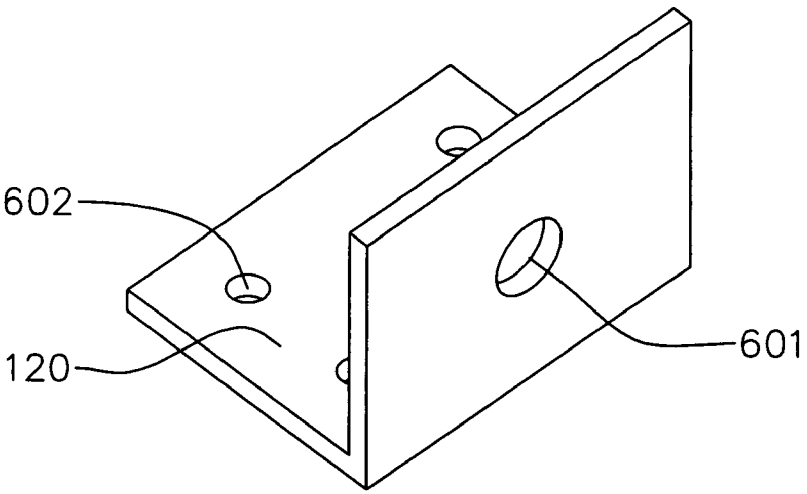
FIG. 19 is a perspective view of the pivot bracket of the present pocket door mounting system.
Figure 22:
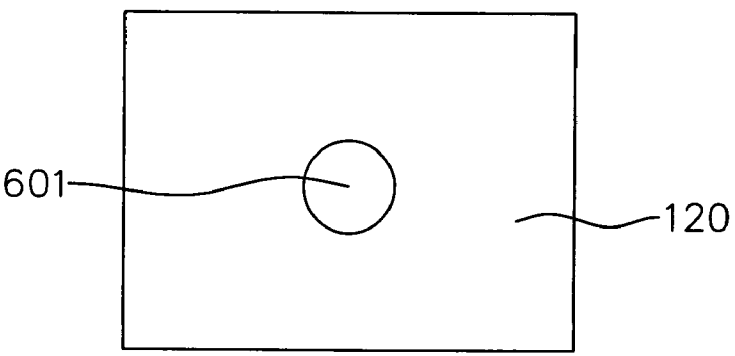
FIG. 22 is a side view of the pivot bracket of FIG. 19.
Figure 20:
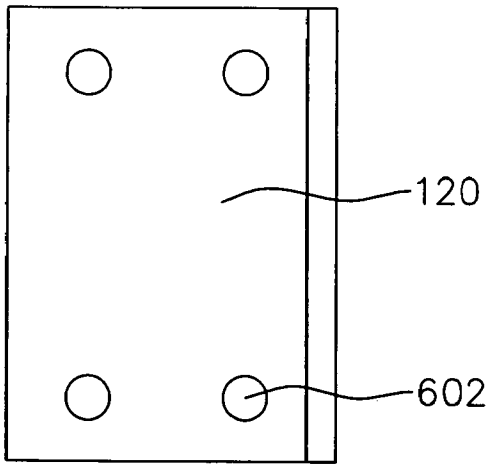
FIG. 20 is a top view of the pivot bracket of FIG. 19.
Figure 21:
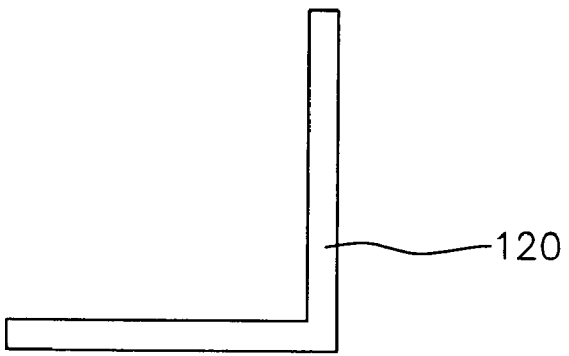
FIG. 21 is an end view of the pivot bracket of FIG. 19.

FIGS. 12-14 show an isometric view and two orthogonal projections of the front view and right side view of the adjustment block 130 of the present invention. The adjustment block 130 is shown having a adjustment screw hole 401 threaded to accept the adjustment screw 131 as shown in FIG. 3. The adjustment block 130 also has several block mounting holes 402, which are described in the context of FIGS. 15-18 below.

FIGS. 15-18 show an isometric view and three orthogonal projections of the top view, front view and right side view of the adjustment bracket 110 of the present invention. The adjustment bracket 110 includes block joining holes 501 machined to match the placement of the block mounting holes 402 in the adjustment block 130. A machine screw or other fastener can be passed through the block joining holes 501 and threaded into the matching block mounting holes 402 to join the adjustment brackets 110 to the adjustment block 130 in the manner shown in FIG. 3. As a result of this union, a gap is left below the adjustment block 130 between the two adjustment brackets 110 joined to the adjustment block 130. This gap restricts the movement of the end of the elongated bar through which the adjustment screw 131 passes, allowing the end of the elongated bar 100 to only travel up and down as the adjustment screw 131 is adjusted into and out of the adjustment block 130.

FIGS. 19-22 show an isometric view and three orthogonal projections of the top view, front view and right side view of the pivot bracket 120 of the present invention. The pivot bracket 120 is shown having a bracket pivot hole 601 and at least one pivot bracket mounting hole 602. As is shown in the embodiment of the pocket door mounting system of FIG. 2, a pair of pivot brackets 120 are disposed on either side of the elongated bar 100. The bracket pivot holes 601 are aligned with the bar pivots holes 202 in the elongated bar 100 such that a bolt or other device may be passed through these holes to created a pivot axis fixed in relation to the pivot brackets 120 around which the elongated bar 100 may easily rotate.

Figure 23:
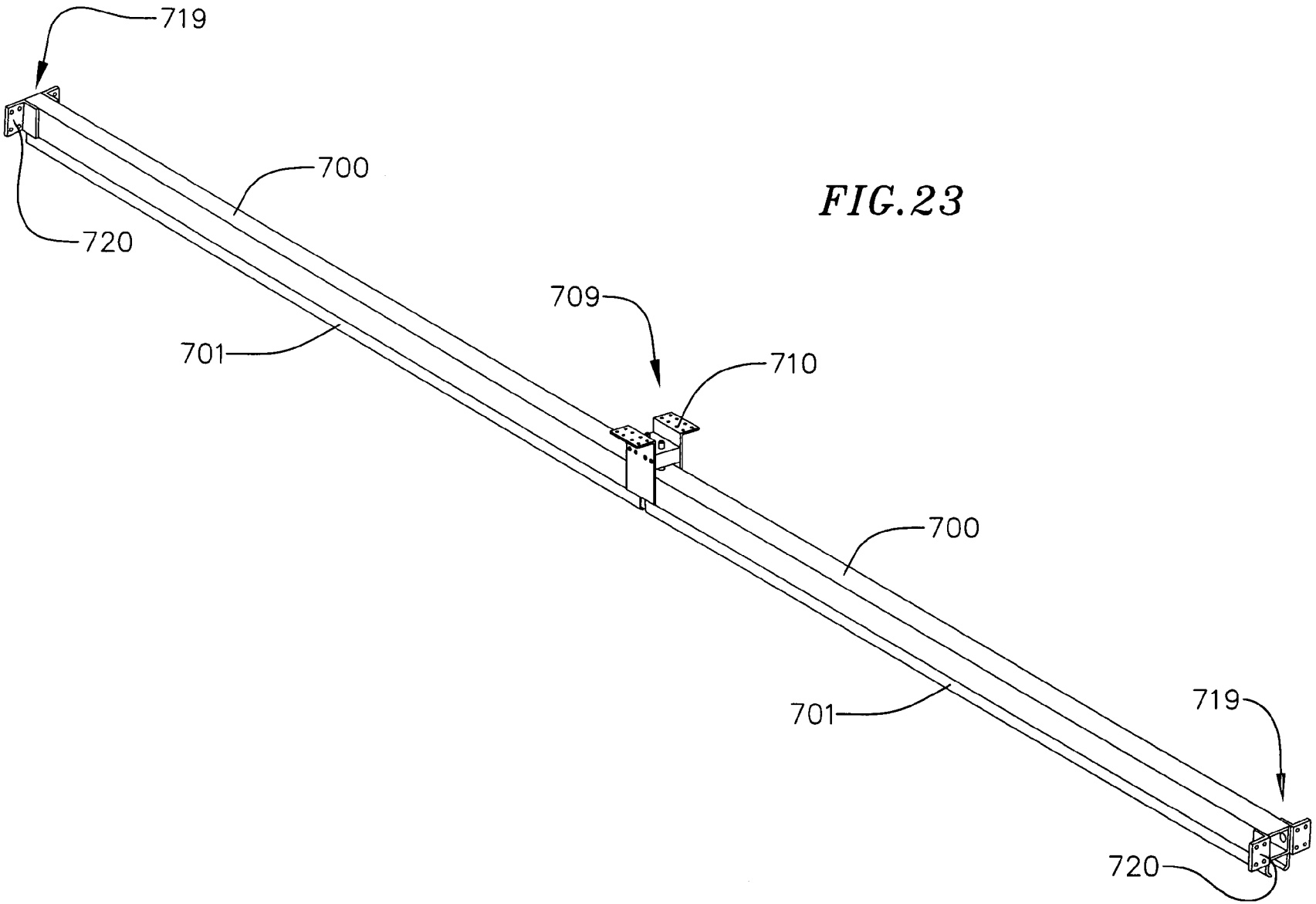
FIG. 23 shows a perspective view of an alternative embodiment of the pocket door mounting system to be used with a pair of individually sliding pocket doors.

FIG. 23 shows a perspective view of an alternative embodiment of the pocket door mounting system to be used with a pair of individually sliding pocket doors. The system shown in FIG. 23 includes an adjustment assembly 709 linking a pair of elongated bars 700. Each elongated bar 700 runs between the adjustment assembly 709 and one of a pair of pivot assemblies 719. Each elongated bar 700 may be connected to the adjustment assembly 709 and one of the pivot assemblies 719 in a manner similar to that shown in the previous figures (i.e. with machine screws, pivot bars or other devices where necessary). Each elongated bar 700 is also attached to a track 701, provided to support a pair of pocket doors.

FIG. 23 also shows adjustment brackets 710 and pivot brackets 720 as part of the adjustment assembly 709 and the pivot assemblies 719, respectively. The pivot brackets 720 may be attached to a pair of trimmers inside a pair of door pockets in the manner of the previous embodiments. The adjustment brackets 710 may be attached to a frame header at a door opening. If the frame header shrinks, shifts and/or warps, the adjustment assembly may be used to realign the pitch of the elongated bars 700 to level them with the door opening.

Figure 24:
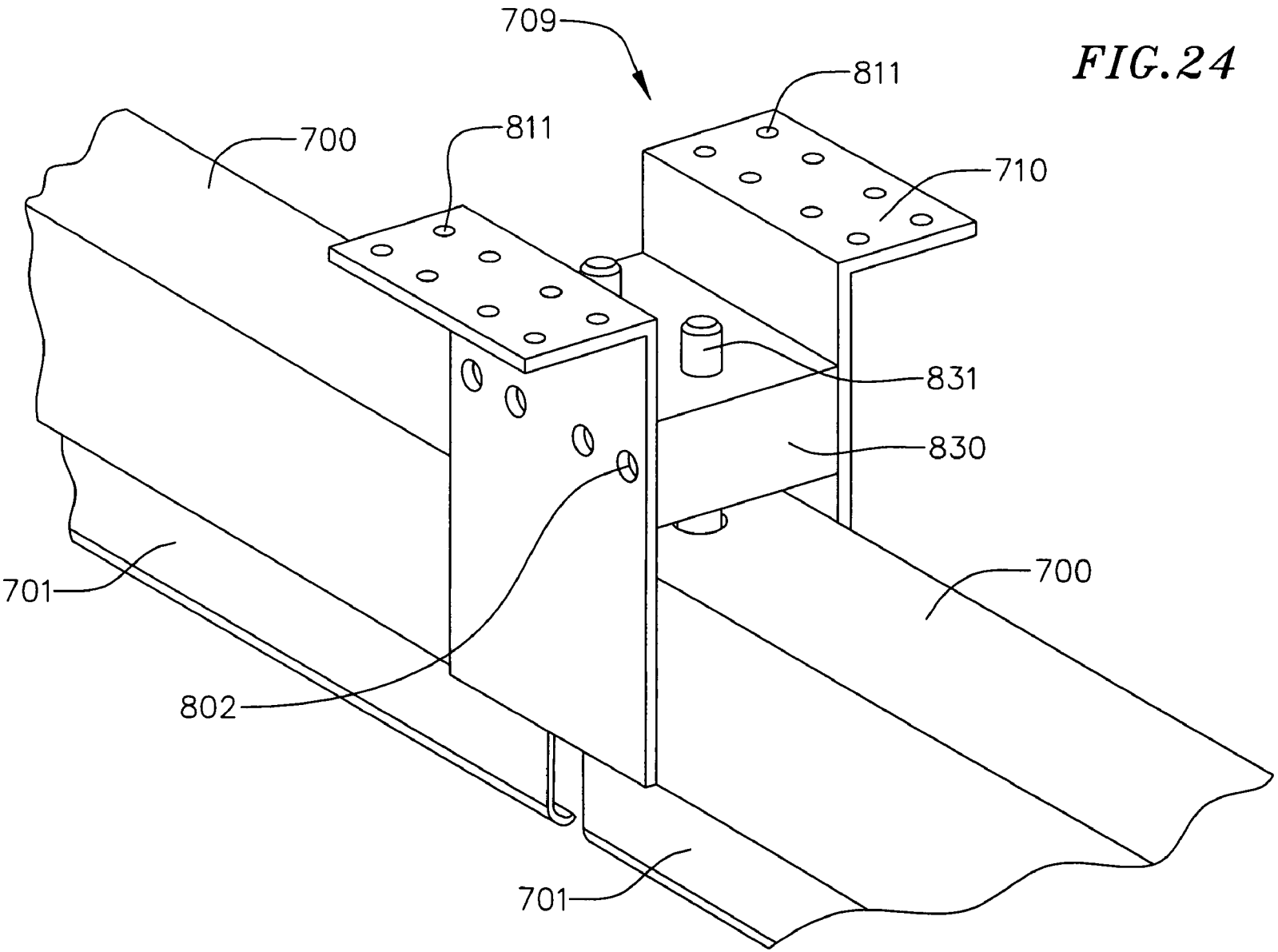
FIG. 24 is a close-up perspective view of the adjustment assembly of the pocket door mounting system of FIG. 23.
Figure 25:
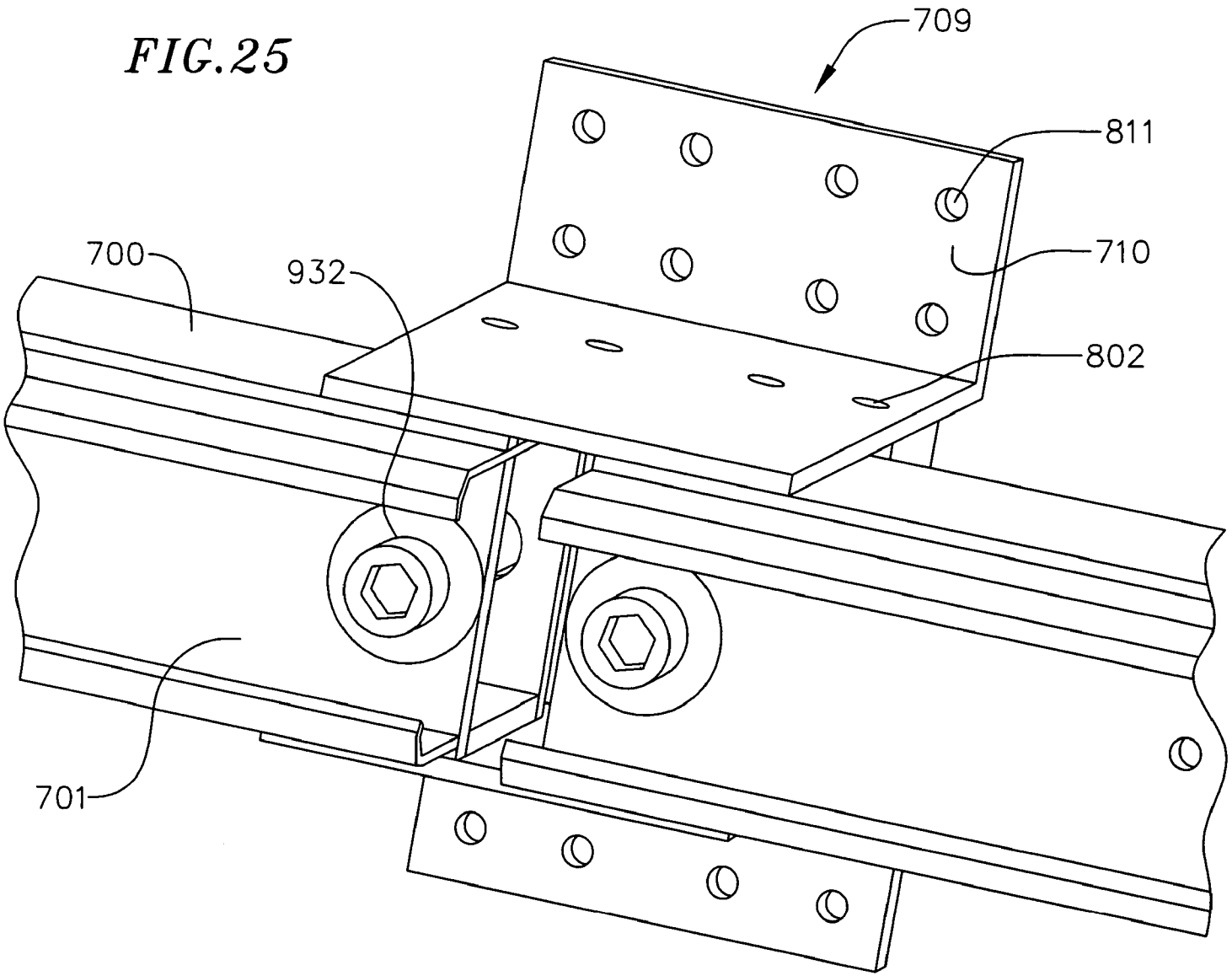
FIG. 25 is a bottom view of the adjustment assembly of FIG. 24.
Figure 26:
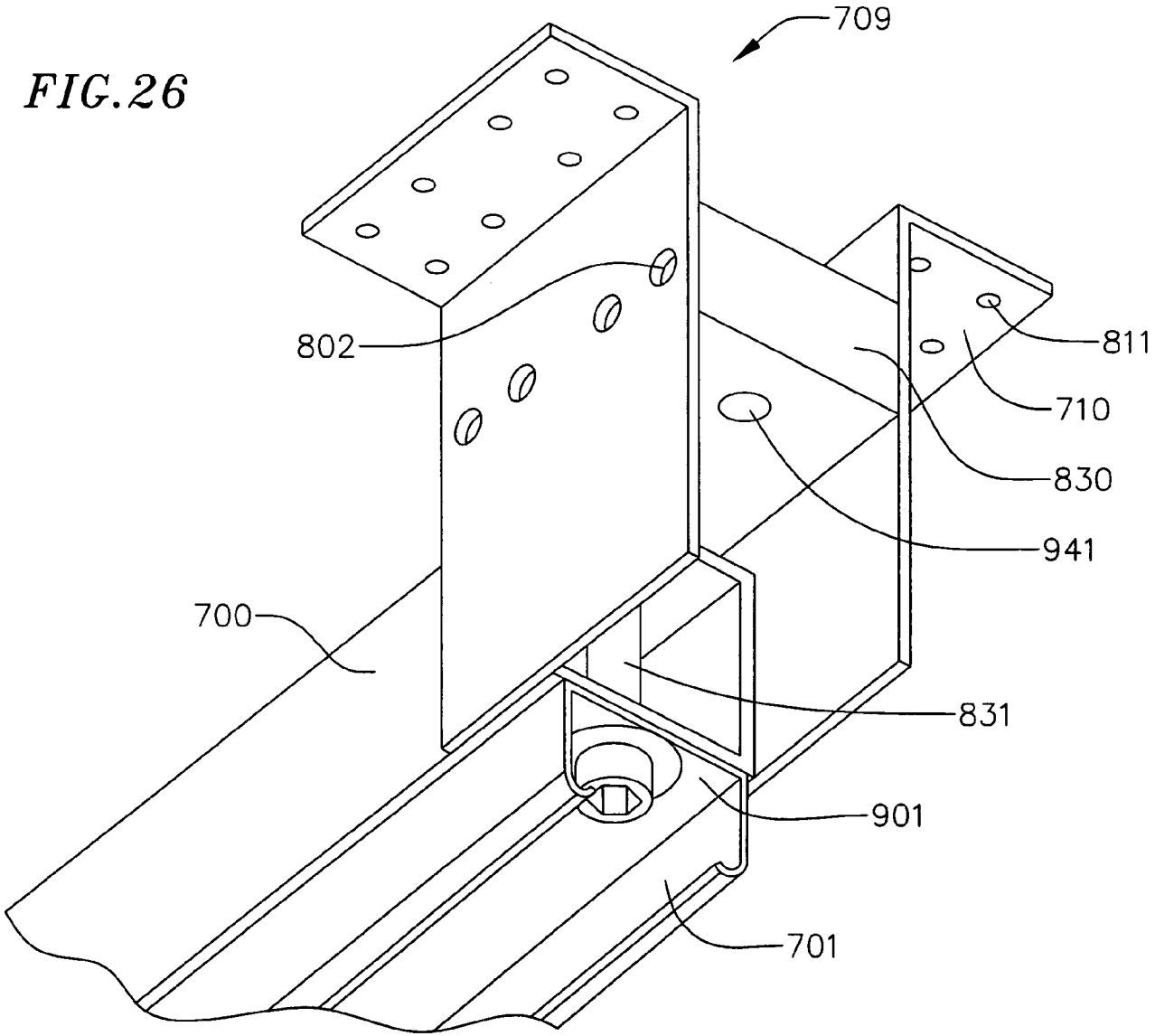
FIG. 26 is another bottom view of the adjustment assembly of FIG. 24.

FIG. 24 is a close-up perspective view of the adjustment assembly shown in FIG. 23 which may be used to maintain the alignment of the present pocket door mounting system supporting two pocket doors. FIG. 25 is a bottom view of the adjustment assembly of FIG. 24, and FIG. 26 shows another bottom view of the adjustment assembly of FIG. 24.

It will be understood that various modifications can be made to the disclosed embodiments of the present invention without departing from the spirit and scope thereof. For example, although the adjustment and pivot assemblies 109 and 119 are described in the context of having a pair of brackets each, one bracket may be used to mount each assembly in an alternative embodiment of the present invention. Therefore, the above description should not be construed as limiting the invention, but merely as an exemplification of preferred embodiments of the invention. Those skilled in the art will envision other modifications within the scope and spirit of the present invention.

What is claimed is:

1. A pocket door mounting system comprising:

a guide for supporting a sliding pocket door, the guide having a bottom side for attaching a thereto, the guide having a first end, a second end opposite the first end, and a longitudinal axis substantially parallel to the bottom side and extending substantially horizontally between the first and second ends;

an adjustment assembly connected to the first end of the guide for adjusting a pitch of the guide, the adjustment assembly including at least one adjustment bracket for mounting to a surface of a first trimmer; and a pivot assembly connected to the second end of the guide, the pivot assembly including at least one pivot bracket for mounting to a surface of a second trimmer, the pivot assembly being connected to the guide at a pivot axis extending through the second end of the guide for allowing the guide to pivot about the pivot axis, the pivot axis being substantially perpendicular to the longitudinal axis of the guide, wherein the adjustment assembly further includes an adjustment block positioned above the guide and having a threaded hole, and a screw threadedly engaged in the threaded hole of the adjustment block and extending through the guide, the screw having a head supporting the guide at the bottom side, the screw being held in tension between the adjustment block and the bottom side of the guide, and said at least one adjustment bracket being attached to the guide and the adjustment block.

2. The pocket door mounting system of claim 1, wherein the track is attached to the bottom side of the guide and is adapted to allow the sliding pocket door to be supported by the guide fully into and out of a wall pocket.

3. The pocket door mounting system of claim 1, wherein a position of the first end of the guide relative to the adjustment bracket may be adjusted up to one inch by the adjustment assembly.

4. The pocket door mounting system of claim 1, wherein the guide is adapted to support the sliding pocket door in both an open and a closed position of the sliding door.

5. The pocket door mounting system of claim 1, wherein the guide forms a substantially constant radius of curvature along its length when subjected to a three point loading.

6. The pocket door mounting system of claim 1, wherein the guide is a rigid member.

7. The pocket door mounting system of claim 1, wherein the at least one adjustment bracket comprises a pair of adjustment brackets attached to the adjustment block, the pair of adjustment brackets forming a gap therebetween when connected to the adjustment block;

wherein the first end of the guide is constrained to move in a substantially vertical direction in the gap formed between the pair of adjustment brackets.

8. The pocket door mounting system of claim 1, wherein the guide comprises an elongated bar; and wherein the track is removably attached to the elongated bar using self-tapping screws.

9. The pocket door mounting system of claim 1, wherein said at least one adjustment bracket has a plurality of first mounting holes for mounting said at least one adjustment bracket to the surface of the first trimmer, and said at least one pivot bracket has a plurality of second mounting holes for mounting said at least one pivot bracket to the surface of the second trimmer.

10. The pocket door mounting system of claim 1, wherein the pivot axis extends horizontally through a center of the second end of the guide.

11. A pocket door mounting system comprising:

a guide for supporting a sliding pocket door, the guide having a bottom side for attaching a track thereto, the guide having a first end, a second end opposite the first end, and a longitudinal axis substantially parallel to the bottom side and extending between the first and second ends;

an adjustment assembly connected to the first end of the guide for adjusting a pitch of the guide, the adjustment assembly including at least one first bracket, said at least one first bracket having a plurality of first mounting holes for mounting said at least one first bracket to a structural member, the adjustment assembly including an adjustment block positioned above the guide, a screw extending from the adjustment block to engage the guide and suspend the guide from the adjustment block, and said at least one first bracket attached to the guide and the adjustment block; and a pivot assembly connected to the second end of the guide, the pivot assembly including at least one second bracket, said at least one second bracket having a plurality of second mounting holes for mounting said at least one second bracket to a surface of a trimmer, the surface of the trimmer being substantially perpendicular to the longitudinal axis of the guide, the pivot assembly being connected to the guide at a single pivot axis extending through the second end of the guide for allowing the guide to pivot about the pivot axis, the pivot axis being substantially perpendicular to the longitudinal axis of the guide.

12. The pocket door mounting system of claim 11, further comprising another guide for supporting another sliding pocket door, and another pivot assembly connected to an end of the another guide for mounting the another guide to another trimmer, the another guide having a longitudinal axis extending from the end of the another guide to an opposite end of the another guide, the longitudinal axis of the guide and the longitudinal axis of the another guide being substantially colinear, wherein the adjustment assembly is connected to the opposite end of the another guide for adjusting a pitch of the another guide, and wherein the adjustment assembly is between the pivot assembly and the another pivot assembly.

* * * * *